US005494010A

United States Patent [19]

Niimi et al.

[11] Patent Number: 5,494,010

[45] Date of Patent: Feb. 27, 1996

[54] MAGNET SWITCH AND A STARTER USING SAME

[75] Inventors: Masami Niimi, Handa; Sadayoshi Kajino, Nagoya, both of Japan

[73] Assignee: Nippondenso Co., Ltd., Kariya, Japan

[21] Appl. No.: 358,826

[22] Filed: Dec. 19, 1994

[30] Foreign Application Priority Data

Dec. 24, 1993 [JP] Japan ..... 5-328642

[51] Int. Cl.[6] ..... F02N 11/00

[52] U.S. Cl. ..... 123/179.25; 290/38 R; 310/71

[58] Field of Search ..... 123/179.25; 310/43, 310/71; 290/38 R, 48

[56] References Cited

U.S. PATENT DOCUMENTS 4,631,434 12/1986 Asaoka et al. ..... 290/38 R
4,695,735 9/1987 Tallis, Jr. et al. ..... 123/179.25

FOREIGN PATENT DOCUMENTS 432572 3/1948 Italy ..... 290/38 R
1-24830 7/1989 Japan .

*Primary Examiner*—Andrew M. Dolinar
*Attorney, Agent, or Firm*—Cushman, Darby & Cushman

[57] ABSTRACT

Disclosed is a starter which prevent a magnetic flux change of field device in a d.c. motor against a magnetic field produced by a battery cable and also prevents contact between the battery cable and the d.c. motor when a vehicle vibrates. In the periphery of a magnet switch cover, a pair of a first fixed contact and a second fixed contact are disposed opposing to a moving contact. The first fixed contact is conducted to a battery connecting terminal which connects to a battery cable. The switch cover covers a opening of the switch casing. A motor cover covers an opening of a motor casing disposed in parallel with a magnet switch. On a mounting surface of the battery cable connecting terminal in the switch cover, a washer protrudes from the back end portion of the motor cover in the axial direction.

11 Claims, 2 Drawing Sheets

MAGNET SWITCH AND A STARTER USING SAME

CROSS REFERENCE TO RELATED APPLICATIONS

This application is based upon and claims priority from Japanese Patent Application 5-328642 filed Dec. 24, 1993, the contents of which are hereby incorporated herein by reference.

BACKGROUND OF THE INVENTION

1. Field of the Invention

The present invention relates to a magnet switch for a starter of an internal combustion engine.

2. Related Art

In a starter having a conventional magnet switch, for example, the magnet switch disclosed in Japanese Utility Model Publication 01-24830, the magnet switch is disposed on the upper portion of a d.c. motor and is fixed by a screw. A fixed seat surface of a battery connecting terminal is located inside of the d.c. motor axial to its back end portion. The cap of the magnet switch is disposed having a stage between the fixed seat surface and a fixed seat surface of the d.c. motor input terminal. These fixed seat surfaces are caulked via a washer with the battery connecting terminal for the fixed seat surface and the d.c. motor input terminal for the fixed seat surface. This publication also discloses a structure which can install a battery cable at any place around the magnet switch as the fixed seat surface of the battery cable connecting terminal protrudes more than the fixed seat surface of the d.c. motor input terminal.

However, as for a starter having magnet switch as described above, especially a low torque speed reduction type starter employing a magnet as a field device for the d.c. motor, a battery cable is wired in the upper portion of d.c. motor because a fixed seat portion of the battery connecting terminal is located on the interior side of the back end portion of d.c. motor. In this state, when an electric current is applied to the battery cable, a magnetic field is produced. This magnetic field changes the magnetic flux of the magnet in the field device, thereby causing a phenomenon where the starter efficiency deteriorates to the same degree as the magnetic flux is changed. In addition, although such a starter can have the battery cable installed at any direction around the periphery of the battery connecting terminal, as a battery cable is disposed in the upper portion of a d.c. motor, when a vehicle vibrates, the battery cable scrapes the d.c. motor so that an insulating coating of the battery cable may peel off.

SUMMARY OF THE INVENTION

The present invention intends to provide a magnet switch for a starter which prevents changes in the magnetic flux of a field device in a d.c. motor against an interfering magnetic field produced when an electric current is applied to a battery cable. Also, the present invention intends to provide a starter which prevents contact between a battery cable and a d.c. motor even when the vehicle vibrates.

According to the present invention, a magnet switch of a starter includes a fixed contact and a moving contact which interrupt carrying current to a starter motor for starting an internal combustion engine. The magnet switch further includes a battery connecting terminal electrically connected to the fixed contact and disposed on the back end portion of a casing in the magnet switch. The battery connecting terminal protrudes towards the exterior of the casing. A connecting seat surface of the battery connecting terminal is located in a more outwards direction than the back end portion of casing of the starter motor.

According to the present invention, as a connecting seat surface of a battery connecting terminal installed in a battery cable in a magnet switch and a back end portion of a casing of the magnet switch are located in a more outward direction than a back end portion of the casing in a motor, a distance between the battery cable and a motor field device can be long, thereby preventing magnetic flux changes of field device against an interfering magnetic field produced when an electric current is applied to the battery cable. Further, deterioration of the starter output is prevented. Further, a battery cable can be prevented from being in contact with a housing of the d.c. motor even if a vehicle vibrates because a terminal of the battery cable can be installed in any direction from the periphery of the battery connecting terminal and the battery cable is not disposed on the motor.

Further, a washer seat surface in a magnet switch cover installed on a battery cable protrude in the direction axial to the back end portion of a motor cover, thereby setting a distance between the washer seat surface and the back end portion of motor cover long, favorably preventing a magnetic flux change in a motor field device without deteriorating a starter output, and further easily preventing contact between the battery cable and a casing of d.c. motor even if a vehicle vibrates.

Furthermore, as a magnet switch casing and a motor casing are integrated with magnetic material and a magnet switch cover and a motor cover are also integrated with heat resisting resin material, the number of parts can be reduced, and the structure of starter can be simplified and downsized.

BRIEF DESCRIPTION OF THE DRAWINGS

Other objects, features, and characteristics of the present invention, along with the function of the related parts, will be better understood by study of the following detailed description, appended claims, and drawings. In the drawings:

DETAILED DESCRIPTION OF THE PRESENTLY PREFERRED EXEMPLARY EMBODIMENTS

Figure 1:
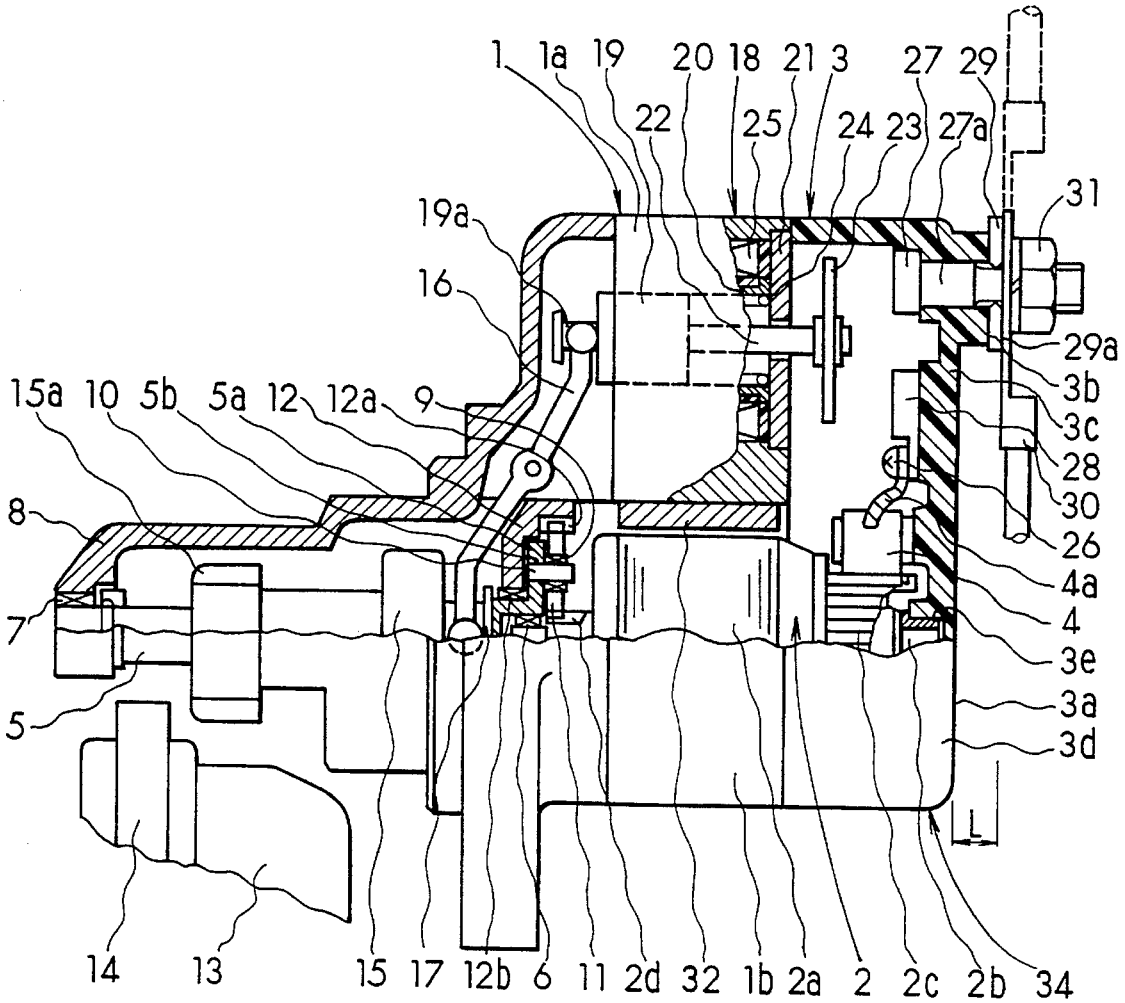
FIG. 1 is a cross-sectional view of a starter according to the first embodiment of the present invention.
Figure 2:
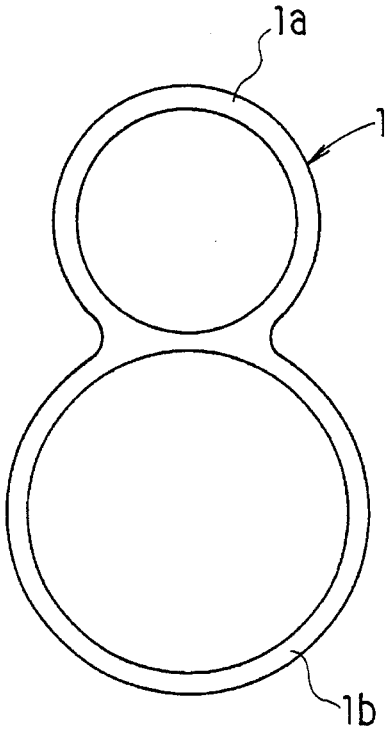
FIG. 2 is a front view of a starter casing shown in FIG. 1.
Figure 3:
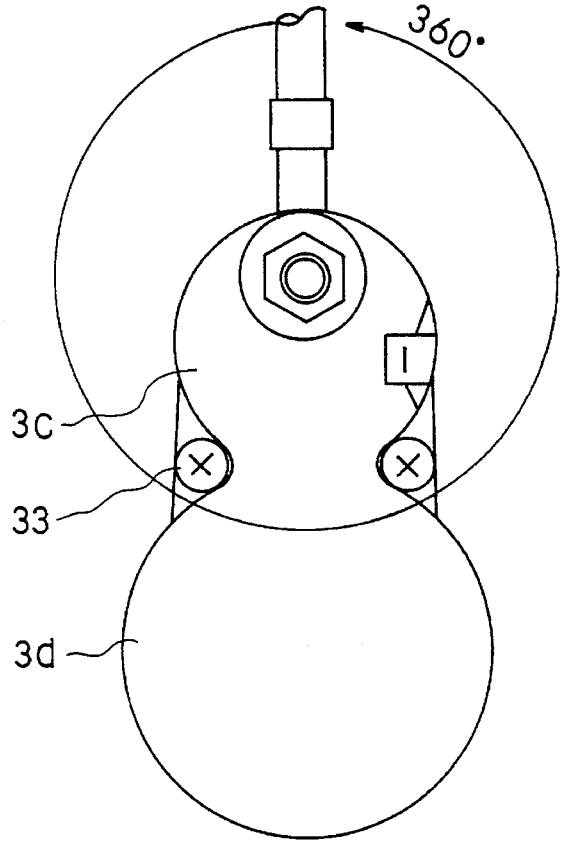
FIG. 3 is a schematic view showing a state of installing a battery cable to the starter of FIG. 1.

A starter of the present invention will be described in detail below with reference to the accompanying drawings. FIG. 1 is a cross-sectional view showing the first embodiment of the present invention, FIG. 2 is a front view of a starter casing, and FIG. 3 is a schematic view showing a state of mounting a battery cable.

Starter casing 1 integrated with a magnetic material comprises cylindrical magnet switch casing 1*a* which contains magnet switch 18 and cylindrical motor casing 1*b* which contains rotary-driven armature 2. Starter cover 3 formed of heat resistant resin material includes switch cover 3*c* which covers an opening portion of magnet switch casing 1*a* and motor cover 3*d* which covers an opening portion of motor casing 1*b*. Starter cover 3 is fixed to casing 1 axially by bolts 33 (FIG. 3). In addition, motor 34 includes motor casing 1*b* and armature 2 disposed in motor cover 3*d* as will be described later.

Magnet 32 constituting a field device is disposed in the peripheral portion of motor casing 1*b*, and armature 2 is disposed within the periphery of magnet 32. Armature 2 is composed of armature core 2*a*, an armature coil (not shown) which is embedded in the outer peripheral portion of armature core 2*a* and armature shaft 2*b* press fitted in armature core 2*a*.

One side (back side) of armature shaft 2*b* is rotatably supported by bearing 3*e* of starter cover 3, and the other side (front side) of armature shaft 2*b* is rotatably supported by bearing 6 disposed in a convex portion of rotation output shaft 5, described below. In addition, commutator 2*c* is fixed to one side of the armature shaft 2*b*. In the outer peripheral portion of commutator 2*c*, brush 4 having pigtail 4*a* fixed to starter cover 3 is rotatably disposed by screw 26 via a second fixed contact 28. Sun gear 2*d* is formed on the outer periphery on the other side of armature shaft 2*b*. Still further, in this side of armature shaft 2*b*, rotation output shaft 5 is disposed on the same axis to or coaxially with armature shaft 2*b*. One edge of the rotation output shaft 5 is rotatably supported by bearing 12*b* mounted on center bearing 12 which is fixed to housing 8, and the other edge of the rotation output shaft 5 is rotatably supported by bearing 7 in housing 8.

Flange-shaped overhang 5*a* is formed on one edge of rotation output shaft 5 protruding in the outer peripheral direction. The overhang 5*a* has a plurality of through holes 5*b* in the peripheral direction. Pins 10 are disposed engaging through holes 5*b* and rotatably supporting planetary gears 11 thereon via bearings 9. Planetary gears 11 engage the outer periphery of aforementioned sun gear 2*d*.

Furthermore, in the outer periphery of flange-shaped overhang 5*a*, internal gear 12*a* is disposed in the inner peripheral surface. Sun gear 2*d*, planetary gears 11 and internal gear 12 compose a speed reduction mechanism.

On the side of rotation output shaft 5 opposite to housing 8 (i.e., at the left bottom portion in the figure), a torque converter 13 is installed along with an automatic transmission (not shown) disposed on a vehicle side. Overrunning clutch 15, having pinion gear 15*a* engageable with ring gear 14 disposed in torque converter 13, is engaged with a helical spline (not shown) of rotation output shaft 5. Change speed lever 16 engages with annular member 17. One end of change speed lever 16 is installed on overrunning clutch 15, and the other end thereof is engaged with joint member 19*a* of plunger 19.

Rotation output shaft 5 is covered by housing 8. The starter casing 1 is fixed between the housing 8 and starter cover 3 via a through bolt 33 which is shown in FIG. 3.

In the inner peripheral portion of magnet switch casing 1*a*, plunger 19 is disposed and set movably in an axial direction of a cylindrical sleeve 20 composed of non-magnetic material, such as brass, as if plunger 19 is guided by sleeve 20. Exciting coil 25 is disposed on the periphery of sleeve 20.

In the edge portion of sleeve 20, stationary core 21 made of magnetic material is inserted. In the middle portion of stationary core 21, an aperture is formed, through which drive shaft 22 penetrates. Drive shaft 22 protrudes from end face of plunger 19. Moving contact 23 is disposed opposing the side face of plunger in stationary core 21 so that moving contact 23 is integrally combined with drive shaft 22. Compression spring 24 is disposed between plunger 19 and stationary core 21 to keep plunger 19 away from stationary core 21 normally.

The edge portion of stationary core 21 is covered with starter cover 3, in which first fixed contact 27 and second fixed contact 28 are disposed opposing moving contact 23. First fixed contact 27 includes battery connecting terminal 27*a* which is fit into starter cover 3. Washer 29 is in contact with mounting seat surface 3*b* of starter cover 3 and engaged with battery connecting terminal 27*a*. Battery connecting terminal 27*a* is connected to battery cable 30 via nut 31. Further, washer seat surface 29*a* of washer 29 on mounting seat surface 3*b* of starter cover 3 protrudes from rear end portion 3*a* of starter cover 3 by length L in the axial direction.

The operation of the embodiment of the present invention described above will be set forth below. When a key switch (not shown) is turned ON, an electric current is carried to exciting coil 25 via battery connecting terminal 27*a* towards which plunger 19 is attracted so as to come into contact therewith. Change speed lever 16 engaged with joint 19*a* is rotated clockwise. By this rotation of change speed lever 16, overrunning clutch 15 is moved forward guided by the helical spline (not shown) along the rotation output shaft 5. Moving contact 23 contacts first fixed contact 27 and second fixed contact 28, and the electric current is carried to armature 2 via brush 4. The armature 2 finally rotates by means of an exciting magnetic flux of magnet 32. This rotation of armature 2 turns planetary gears 11 engaged with the internal gear 12 and sun gear 5*a* on armature shaft 2*b* so as to rotate overhang 5*b* and rotation output shaft 5 in a reduced rotation speed.

This reduced rotation is transmitted via the helical spline (not shown) to overrunning clutch 15, which slides over rotation output shaft 5. Pinion gear 15*a* engages with ring gear 14, ring gear 14 rotates, and then the engine starts.

After starting the engine, when pinion gear 15*a* is counter-rotated by ring gear 14, the rotation transmitted from ring gear 14 is not transmitted due to the operation of overrunning clutch 15, thereby preventing armature 2 from overrunning. When the key switch is turned OFF for completion of the starting of the engine, electrical current supply to magnet switch 18 is stopped, and then plunger 19 springs back to its initial position by force from spring 24. Thus, moving contact 23, first fixed contact 27, and second fixed contact 28 are opened, feeding electrical current to armature 2 is stopped, and then pinion gear 15*a* is uncoupled from ring gear 14.

Figure 4:
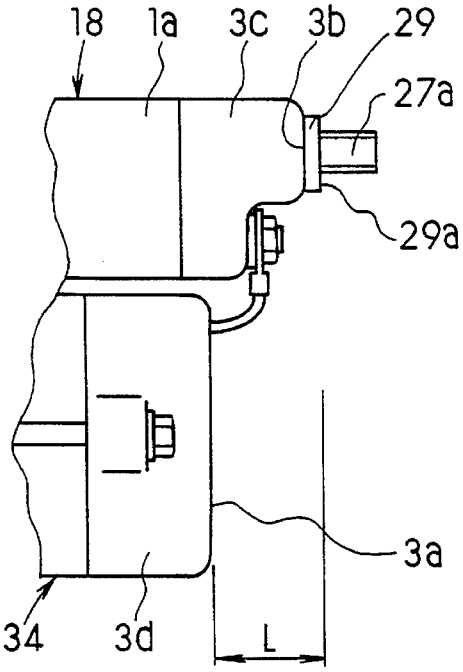
FIG. 4 is a partial side view showing second embodiment of the present invention.

FIG. 4 shows the second embodiment of the present invention. This embodiment separates motor cover 3*d* containing armature from magnet switch cover 3*c* containing a magnet switch. Washer 29 is disposed on mounting seat surface 3*b* of the magnet switch cover 3*c* and is engaged with battery connecting terminal 27*a*. Washer seat surface 29*a*, which contacts a battery cable, protrudes from back end portion 3*a* of starter cover 3 by length L in the axial direction.

According to the embodiment, as seat bearing surface 29*a* is in contact with battery cable 30 and magnet switch cover 3*c* protrudes from back end portion 3*a* of motor cover 3*d* by length L in the axial direction, the distance between battery cable 30 and the field device, i.e. magnet 32, can be long, thereby preventing the changes in magnetic flux of the field device, i.e. demagnetization, and deterioration of rectification and also preventing deterioration of starter output. In addition, as battery cable 30 can be installed in any direction of the periphery of battery connecting terminal 27*a* as shown in FIG. 3 and is not disposed on motor 34, battery cable 30 can be prevented from contacting with motor 34 even if a vehicle is subjected to vibration.

Motor cover 3*d* and magnet switch cover 3*c* may be integrated, thereby reducing the number of parts, and both simplifying and reducing in size the structure of the starter. Also in the embodiment of the present invention shown in FIG. 1, it is possible to move a magnet switch 18 backward to line up the back end portion of magnet switch 18 with the back end of motor 34, thereby becoming integral with starter cover 3, connecting with brush 4 from second fixed contact 28 directly to inside of the magnet switch 18, and removing a motor lead wire. This prevents poor operation of the starter due to rusting.

Further, in each of the embodiments of the present invention mentioned above, as the whole magnet switch 18 is moved to the back end side of motor 34, there is space between the front of the magnet switch 18 and the engine mounting portion, thereby setting a large range of rest positions for the pinion gear 15, improving starter installation, and allowing easy installation even on a vehicle with a torque converter.

This invention has been described with reference to what are presently considered to be the most practical and preferred embodiments of the present invention. However, this invention is not meant to be limited to the disclosed embodiments, but rather is intended to cover all modifications and equivalent arrangements included within the spirit and scope of the appended claims.

What is claimed is:

1. A magnet switch for a starter motor which starts an engine, said starter motor including an output shaft which operatively engages with a ring gear of the engine and being provided in a motor casing means, the motor casing means having an axial end face positioned axially opposite to the output shaft, said magnet switch comprising:

movable and fixed contacts provided in a switch casing means for controlling electric power supply to said starter motor, said switch casing means being mounted directly on and in parallel to the motor casing means; and a battery connecting terminal connected to said fixed contact and having a battery cable contacting surface disposed entirely axially beyond and outwardly from the axial end face of the motor casing means.

2. A starter comprising:

a switch casing including therein an excitation coil and a plunger;

a motor casing disposed in parallel with said switch casing in direct contact with said switch casing and including therein a field device and an armature;

a cover closing axial ends of said switch casing and said motor casing and including therein a fixed contact which contacts with a movable contact coupled with said plunger; and a battery connecting terminal secured to said cover and connected to said fixed contact, said terminal having a battery cable connecting surface at a position displaced axially outside from an axial end of said cover so that said battery cable may be connected without touching said cover for said motor casing.

3. A starter according to claim 2, wherein said switch case and said motor casing are made integrally of a magnetic material and said cover is made of a heat resistant resin material, said cover including a motor cover portion axially adjacent to said motor casing and a switch cover portion axially adjacent to said switch casing, said switch cover portion having an extended portion extending axially outside said motor cover portion for defining said connecting surface.

4. A starter for an internal combustion engine, said starter being connectable to a battery, said starter comprising:

a starter housing;

a starter motor disposed in said housing and having a rotary shaft; and a magnet switch for transmitting electrical power from said battery to said starter motor so as to start said engine, wherein said magnet switch is mounted in parallel with said motor, wherein said magnet switch includes a battery connecting terminal having a cable connecting seat surface to which a battery cable connects electrically, and wherein said seat surface of said battery connecting terminal is disposed entirely axially beyond and protrudes by a predetermined distance from an axial end of said starter housing at which said rotary shaft of said starter motor is supported.

5. A starter as claimed in claim 4, wherein said starter housing includes a magnetic switch casing containing said magnet switch, a motor casing containing said starter motor, and a switch cover, and wherein said magnetic switch casing and said motor casing are formed of a first material and said switch cover is formed of a second material.

6. A starter as claimed in claim 4, wherein said magnet switch comprises a plunger, a drive shaft, a switch cover for said magnet switch and a moving contact disposed at one end of said drive shaft, and wherein said battery connecting terminal includes a first fixed contact that transmits energy from said battery cable to said moving contact.

7. A starter as claimed in claim 6, wherein said first fixed contact includes a fastening means for securing said battery cable to said switch cover, and wherein said fastening means is adapted to allow said battery cable to be secured in any radial direction of a circle formed around said fastening means with said battery cable being in contact with said seat surface.

8. A starter as claimed in claim 6, wherein said battery connecting terminal is connectable to a second fixed contact provided axially inside said switch cover, wherein said starter motor includes an armature, and wherein said second fixed contact supplies electrical power to said armature through a pig tail provided inside said switch cover when said moving contact contacts said first and second fixed contacts.

9. A starter as claimed in claim 5, wherein said second material is non-magnetic material and said first material is magnetic material.

10. A starter for starting an engine with electric power from a battery through a battery cable, said starter comprising:

a motor casing of generally cylindrical shape;

a motor housed in said motor casing and having a field device and an armature for rotating a rotary shaft, said rotary shaft having two axial ends one of which is positioned close to a ring gear of said engine;

a motor cover closing an axial end of said motor housing and rotatably supporting the other of said two axial ends of said rotary shaft;

a switch casing of generally cylindrical shape and mounted directly on and parallel with said motor casing;

a magnet switch housed in said switch casing and having a movable contact which is moved axially in parallel with said rotary shaft;

a switch cover closing an axial end of said switch at a position adjacent to said motor cover;

a first and second fixed contacts fixed to said switch cover at an inside of said switch cover to be contacted by said movable contact, said second fixed contact being connected electrically to said motor; and a battery connecting terminal fixed to said switch cover and electrically connected to said first fixed contact and extending axially outwardly from said switch cover for electrically connecting with said battery cable, said battery connecting terminal having a seat surface formed at a position disposed entirely axially beyond and axially displaced outwardly by a predetermined distance from an axial endmost surface of said motor cover for receiving said battery cable thereon so that said battery cable may be connected at said seat surface in any angular direction without contacting said motor casing and said motor cover.

11. A starter according to claim 10, wherein:

said motor cover and said switch cover are made integrally to have a generally same axial outside surface.

* * * * *